United States Patent [19]

Ekbom

[11] Patent Number: 5,000,911

[45] Date of Patent: Mar. 19, 1991

[54] METHOD IN MANUFACTURING BLADES OR VANES OF TURBINES

[75] Inventor: Ragnar Ekbom, FinspÅng, Sweden

[73] Assignee: ABB Stal Ab, Finspang, Sweden

[21] Appl. No.: 531,043

[22] Filed: May 31, 1990

[30] Foreign Application Priority Data

Jun. 1, 1989 [SE] Sweden ..... 8901985-5

[51] Int. Cl.[5] ..... B22F 5/00

[52] U.S. Cl. ..... 419/49; 419/38

[58] Field of Search ..... 419/49, 38

[56] References Cited

U.S. PATENT DOCUMENTS

| | | | |
|---|---|---|---|
| 3,841,870 | 10/1974 | Hamjian | 75/226 |
| 4,096,615 | 6/1978 | Cross | 75/226 |
| 4,368,074 | 1/1983 | Otto et al. | 419/48 |
| 4,735,656 | 4/1988 | Schaefer et al. | 75/238 |

FOREIGN PATENT DOCUMENTS

| | | |
|---|---|---|
| 0074800 | 8/1982 | European Pat. Off. . |
| 1443630 | 12/1974 | United Kingdom . |
| 1512119 | 12/1976 | United Kingdom . |
| 2208490 | 8/1988 | United Kingdom . |

OTHER PUBLICATIONS

IBM Technical Disclosure Bulletin, vol. 24, No. 7A.

*Primary Examiner*—Stephen J. Lechert, Jr.
*Attorney, Agent, or Firm*—Leydig, Voit & Mayer

[57] ABSTRACT

The invention relates to a method for manufacturing a blade or vane of a turbine. A master of the blade or the vane is made of steel, and silicon rubber is molded around said master. The mold thus obtained is cut open and removed from the master to be used for producing a model of wax or the like, a mixture of graphite powder and a cement then being molded around said model. The model is melted and removed from the graphite mold which is filled with a compacted powder of metal or metal alloy. The mold with the powder compacted therein is isostatically hot pressed and then the mold is removed from the produced molded body by blasting.

5 Claims, No Drawings

METHOD IN MANUFACTURING BLADES OR VANES OF TURBINES

The invention relates to a method for manufacturing blades and vanes of turbines.

According to conventional methods blades and vanes of turbines are manufactured - as far as large blades or vanes are concerned - by precision forging or other working of bar stock and - as far as small blades or vanes are concerned - by precision molding in molds of alumina. These manufacturing methods are expensive and, therefore, other methods are sought for which make it possible to reduce the costs.

The present invention is a contribution in this direction by the method of the invention having obtained features of claim 1.

The invention is illustrated by the following exemplifying embodiment.

If a turbine blade is to be manufactured there is initially produced a master blade of steel the shape of which is in exact agreement with the turbine blade to be manufactured but all measures of which are 10% larger than corresponding measures of the turbine blade. The master blade can be manufactured by conventional stock removal, and it is intended for use in manufacturing a large number of turbine blades.

The master blade is molded of a suitable molding material which is elastic and can be cut easily by means of a knife. A molding material of this type which is preferred according to the invention consists of silicon rubber because a mold made thereof can be easily cut open and easily removed from the master blade which leaves a shaped permanent cavity in the silicon rubber mold corresponding to the shape of the master blade. This cavity is filled with a liquid material which is allowed to set in the mold cavity, e.g. wax, plastics or an alloy having a low melting temperature such as CERBOBEND or CEROTRUE (registered trademarks), which have no coefficient of expansion. The model of the turbine blade to be manufactured molded in the silicon rubber mold is removed from the mold cavity, and one and the same silicon rubber mold in this manner can be used for manufacturing a desired number of turbine blade models.

Around the turbine blade model there is now produced according to the invention by molding a new mold, this time, of a mixture of graphite powder and a cement of the same type as that used for binding graphite, and this mixture is allowed to set around the model. The mold is produced with an ingot, and the model is removed from the mold by melting the model (wax, alloy) or by dissolving the model by means of a suitable solvent (plastics).

In the cavity of the graphite mold a powder of the metal or metal alloy from which the turbine blade is to be produced, e.g. 12% Cr steel, is compacted and the filled mold is located in a casing for isostatic hot pressing, surrounded by powder of alumina, zirconium silicate or graphite inside the casing, which is then closed and evacuated in the conventional manner for following hot isostatic pressing.

After the hot isostatic pressing the casing is removed and the graphite mold with the isostatically hot pressed turbine blade obtained therein is taken out from the casing. The turbine blade is uncovered by removing the graphite mold from the turbine blade by blasting.

What is claimed is:

1. A method of preparing a blade or vane of turbines, comprising the steps of producing a master blade or vane of steel by mechanical working, molding a soft and elastic mold material around the master, cutting open the mold obtained by the molding and removing the mold from the master, filling the cavity in the mold, corresponding to the master, with a liquid material capable of setting in the mold cavity, removing the model of the blade or vane thus produced in the mold from said mold, molding around the model a mold having an ingot of a mixture of graphite powder and a cement, removing the model from the graphite mold by melting or dissolving the model, packing a powder of metal or metal alloy in the mold, isostatically hot pressing the mold with powder compacted therein, and removing the mold after the isostatic hot pressing from the molded body produced in the mold, by blasting.

2. The method according to claim 1 wherein the master is made 10% larger than the blade or vane to be manufactured.

3. Method as in claim 1 wherein silicon rubber is molded around the master.

4. Method as in claim 1 wherein the casing for isostatic hot pressing is filled with a powder of alumina, zirconium silicate or graphite around the graphite mold.

5. Method as in claim 1 wherein the model is made of wax, plastics or an alloy having a low melting temperature.

* * * * *